US009147936B1

(12) United States Patent
Apostolos et al.

(10) Patent No.: US 9,147,936 B1
(45) Date of Patent: Sep. 29, 2015

(54) LOW-PROFILE, VERY WIDE BANDWIDTH AIRCRAFT COMMUNICATIONS ANTENNAS USING ADVANCED GROUND-PLANE TECHNIQUES

(75) Inventors: John T. Apostolos, Lyndeborough, NH (US); Judy Feng, Nashua, NH (US); William Mouyos, Windham, NH (US); Benjamin McMahon, Nottingham, NH (US)

(73) Assignee: AMI Research & Development, LLC, Windham, NH (US)

( * ) Notice: Subject to any disclaimer, the term of this patent is extended or adjusted under 35 U.S.C. 154(b) by 344 days.

(21) Appl. No.: 13/536,445

(22) Filed: Jun. 28, 2012

Related U.S. Application Data

(60) Provisional application No. 61/502,246, filed on Jun. 28, 2011, provisional application No. 61/582,887, filed on Jan. 4, 2012, provisional application No. 61/596,972, filed on Feb. 9, 2012, provisional application No. 61/590,894, filed on Jan. 26, 2012.

(51) Int. Cl.

| | |
|---|---|
| ***H01Q 1/28*** | (2006.01) |
| ***H01Q 21/26*** | (2006.01) |
| ***H01Q 3/46*** | (2006.01) |
| ***H01Q 3/44*** | (2006.01) |
| ***H01Q 21/06*** | (2006.01) |
| ***H01Q 9/28*** | (2006.01) |

(52) U.S. Cl.
CPC ..... *H01Q 3/446* (2013.01); *H01Q 1/286* (2013.01); *H01Q 9/285* (2013.01); *H01Q 21/062* (2013.01); *H01Q 21/26* (2013.01)

(58) Field of Classification Search
CPC ... H01Q 3/446; H01Q 21/062; H01Q 5/0086; H01Q 1/48; H01Q 9/065; H01Q 1/286–1/287
USPC ..... 343/848, 905
See application file for complete search history.

(56) References Cited

U.S. PATENT DOCUMENTS

| | | | |
|---|---|---|---|
| 6,313,716 | B1 | 11/2001 | Apostolos |
| 6,323,814 | B1 | 11/2001 | Apostolos |
| 6,359,599 | B2 | 3/2002 | Apostolos |
| 6,373,440 | B2 | 4/2002 | Apostolos |
| 6,373,446 | B2 | 4/2002 | Apostolos |
| 6,384,792 | B2 | 5/2002 | Apostolos |
| 6,404,391 | B1 | 6/2002 | Apostolos |
| 6,480,158 | B2 | 11/2002 | Apostolos |
| 6,486,850 | B2 | 11/2002 | Apostolos |
| 6,492,953 | B2 | 12/2002 | Apostolos |
| 6,504,508 | B2 | 1/2003 | Apostolos |
| 6,590,543 | B1 | 7/2003 | Apostolos |

(Continued)

OTHER PUBLICATIONS

Jay, Frank (Ed.), IEEE Standard Dictionary of Electrical and Electronics Terms, Second Edition, The Institute of Electrical and Electronics Engineers, Inc., New York, NY, 1977, p. 636.

*Primary Examiner* — Sue A Purvis
*Assistant Examiner* — Amal Patel
(74) *Attorney, Agent, or Firm* — Cesari and McKenna, LLP

(57) ABSTRACT

A low profile antenna using a cavity-backed central radiating surface surrounded by one or more ground plane surfaces. Passively reconfigurable structure provide frequency dependent coupling between the surfaces. The frequency dependent couplings may be implemented using meander line structures, Variable Impedance Transmission Lines (VITLs), or tunable VITLs that used interspersed electroactive sections.

10 Claims, 10 Drawing Sheets

(56) References Cited

U.S. PATENT DOCUMENTS

| | | | | |
|---|---|---|---|---|
| 6,597,321 | B2 * | 7/2003 | Thursby et al. | 343/744 |
| 6,731,247 | B2 | 5/2004 | Apostolos | |
| 6,753,816 | B1 | 6/2004 | Apostolos | |
| 6,771,224 | B2 | 8/2004 | Apostolos | |
| 6,774,745 | B2 * | 8/2004 | Apostolos | 333/161 |
| 6,791,502 | B2 | 9/2004 | Apostolos et al. | |
| 6,828,947 | B2 * | 12/2004 | Apostolos et al. | 343/895 |
| 6,833,815 | B2 | 12/2004 | Apostolos | |
| 6,839,036 | B1 | 1/2005 | Apostolos et al. | |
| 6,842,154 | B1 | 1/2005 | Apostolos | |
| 6,856,288 | B2 | 2/2005 | Apostolos et al. | |
| 6,882,322 | B1 | 4/2005 | Apostolos et al. | |
| 6,894,656 | B2 | 5/2005 | Apostolos et al. | |
| 6,900,770 | B2 | 5/2005 | Apostolos | |
| 6,903,689 | B2 | 6/2005 | Apostolos et al. | |
| 7,109,927 | B2 | 9/2006 | Gilbert et al. | |
| 7,167,137 | B2 | 1/2007 | Apostolos | |
| 7,190,322 | B2 | 3/2007 | Apostolos et al. | |
| 7,209,092 | B2 | 4/2007 | Apostolos et al. | |
| 7,358,920 | B2 | 4/2008 | Apostolos et al. | |
| 7,436,369 | B2 * | 10/2008 | Apostolos | 343/741 |
| 7,586,453 | B2 | 9/2009 | Apostolos | |
| 7,589,684 | B2 | 9/2009 | Apostolos | |
| 7,609,215 | B2 | 10/2009 | Apostolos | |
| 7,623,075 | B2 * | 11/2009 | Apostolos | 343/700 MS |
| 8,081,130 | B2 | 12/2011 | Apostolos et al. | |
| 8,816,925 | B2 | 8/2014 | Apostolos et al. | |

* cited by examiner

LOW-PROFILE, VERY WIDE BANDWIDTH AIRCRAFT COMMUNICATIONS ANTENNAS USING ADVANCED GROUND-PLANE TECHNIQUES

RELATED APPLICATION(S)

This application claims the benefit of U.S. Provisional Application No. 61/502,246, filed on Jun. 28, 2011, U.S. Provisional Application No. 61/582,887 filed on Jan. 4, 2012; U.S. Provisional Application No. 61,590,894 filed on Jan. 26, 2012 and U.S. Provisional Application No. 61/596,972 filed on Feb. 9, 2012.

The entire teachings of the above application(s) are incorporated herein by reference.

BACKGROUND

This application relates to low profile, conformal antennas.

It is known that wide bandwidth, miniaturized antennas can be provided using planar conductors fed through frequency-dependent impedance elements such as meander lines. By arranging these components in an appropriate configuration, the electrical properties of the antenna can be passively and automatically optimized over a wide bandwidth. In one arrangement, a conductive surface placed over a conductive cavity serves as a primary radiator, and meander line components are embedded within the conductive cavity. This approach is particularly useful in aircraft and other vehicle applications since no part of the antenna needs to protrude beyond the skin of the vehicle. The approach can also be adapted to wireless devices and laptop computers and the like where the antenna height can be minimized.

In one specific implementation, a wideband antenna can be provided using these techniques that covers not only the cellular telephone frequencies, but also the Personal Communicator System (PCS), IEEE 802.11 (Wi-Fi) and GPS frequency bands. See for example U.S. Pat. No. 7,436,369 issued to Apostolos.

SUMMARY

According to various teachings herein, a low profile antenna is provided by a cavity-backed central radiating surface. The central radiator is further surrounded by one or more additional conductive surfaces that act as ground plane elements. Passively reconfigurable surface impedances operate as a frequency dependent coupling between the central radiator and the ground plane elements(s). The surrounding ground plane elements are further connected to cavity walls with the passively reconfigurable couplings.

The center radiating element is designed to operate efficiently, decoupled from the ground plane elements, at a relatively high radiation frequency of interest. The ground plane elements, being coupled to the central radiator in a frequency-dependent fashion, only become active as the frequency decreases. As the radiating frequency decreases, the active ground plane gradually expands to eventually the entire top surface of the structure when the lowest design frequency is reached.

The frequency dependent couplings may be implemented using meander line structures. The meander line structures may take various forms such as interconnected, alternating, high and low impedance sections disposed over a conductive surface.

The frequency dependent couplings may also take the form of a Variable Impedance Transmission Line (VITL) that consists of a meandering metallic transmission line with gradually decreasing section lengths, with interspersed dielectric portions to isolate the conductive segments. Specific embodiments of the VITL structure may further include electroactive actuators that alter the spacing between dielectric and metal layers to provide a Tunable Variable Impedance Transmission Line (TVITL).

In other embodiments, the canonical center radiating element may take the form of a generally rectangular (or other quadrilateral) radiating structure with four facing triangular conductive sections. The triangular sections are electrically connected into two crossed, bow-tie structures to provide circular polarization. With this arrangement of conductive surfaces, coverage can be provided in a hemispherical radiation pattern from the horizon to the zenith (or nadir, depending on installation orientation) using a planar, conformal structure.

In still other arrangements, an array of center radiating cells can be placed in a common plane. The entire array is then surrounded with one or more ground plane sections. In this arrangement the array of radiating cells can approach the operation of a monopole antenna with a conformal planar surface.

In one particular implementation, the center radiating cell may be duplicated on both sides of a common cavity. This arrangement thus consists of four triangular elements disposed back to back, providing two outward radiating surfaces. These elements may then stacked in a vertical array to provide even broader bandwidth coverage than is possible with a single cell. The multiple stacked elements are coupled to one another through additional variable impedance couplings such as meander lines, VITL, or TVITLs.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments follows.

The teachings of all patents, published applications and references cited herein are incorporated by reference in their entirety.

This document describes various low-profile, conformal antenna solutions that incorporate ground plane, element array, and electroactive materials in novel ways. The approaches discussed here are particularly useful in aircraft and other vehicle communication uses. However, they can also be used to provide antennas wherever low profile is important, such as in portable wireless communication devices. In general, the solutions presented here combine conformal and/or low-profile antenna technology with passive tuning technology to yield a reconfigurable surface impedance structure that can cover a wide range of frequencies.

The general approach is to provide a cavity-backed surface radiator as a center radiating element with one or more surrounding ground plane structure(s). The ground plane(s) and center radiator are connected to one another using passive, frequency dependent, coupling circuits. These couplers provide the desired turning to achieve high power capability (100 Watts) and low Voltage Standing Wave Ratio (VSWR) within the low-profile form factor.

Figure 1:
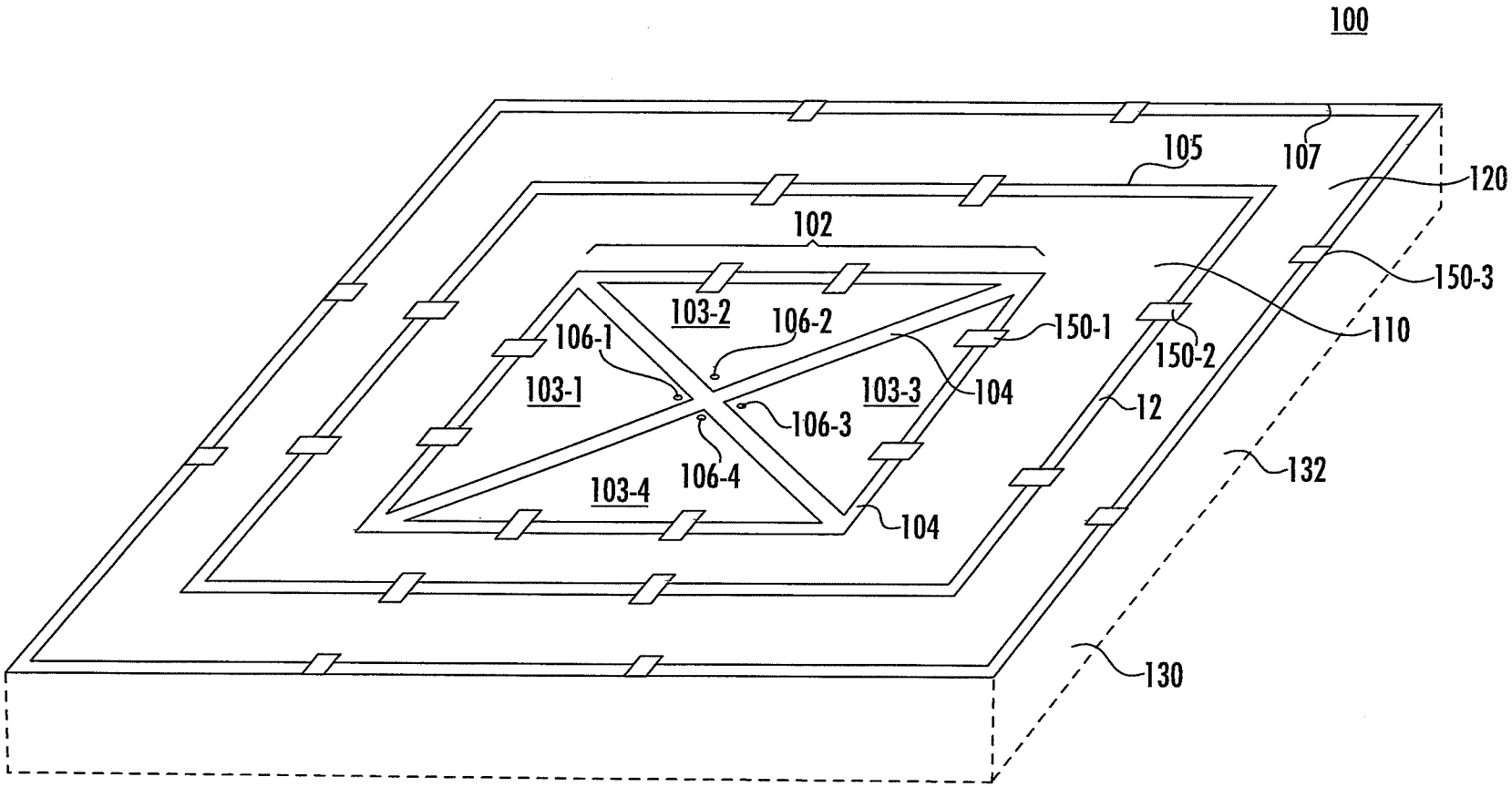
FIG. 1 is a perspective view of a low-profile cavity-backed antenna.

Turning attention to FIG. 1, a first implementation of one such conformal antenna structure 100 is shown. The antenna structure 100 consists of a center radiating surface 102 (also called a cell herein) surrounded by one or more controlled impedance ground plane surfaces 110, 120. An innermost, or first, ground plane cell 110 is positioned closest to an electrically surrounds the center radiating cell 102. The outermost or second ground plane cell 120 is adjacent to and electrically surrounds the first ground plane cell 110. While the ground plane cells 110, 120 are shown to each consist of a single, unitary, uniform, unbroken, conductive surface that completely surround the center cell, it should be understood that these cells may be made of individual pieces spaced closely enough to one another to appear as a single surrounding surface at the operating frequencies of interest.

The center radiator 102 and ground plane cells 110, 120 are positioned over a cavity 130 that is defined by conductive walls 132.

Passive frequency dependent tuning structures, herein called couplers 150, are disposed between the center cell 102 and first ground plane cell 110, and between the first ground plane cell 110 and second ground plane cell 120, and between the second ground plane cell 120 and walls 132 of cavity 130.

The resulting antenna pattern is hemispherical when the center element is circularly polarized. Circular polarization can be achieved by implementing the center element as a pair of crossed bow-tie radiators. As shown, these include four, generally triangular shaped, radiating surfaces 103-1, 103-2, 103-3, 103-4 arranged within the confines of the generally rectangular center radiator 102. The triangular radiating surfaces are arranged with their respective bases along a corresponding side of the rectangle, and their peaks adjacent one another. Each triangular section 103 has a respective feed point 106 that is electrically combined with the feed points from the other sections 103 such as by using hybrid combiners. The resulting radiation pattern extends in a hemispherical pattern from the horizon to zenith (or nadir, depending on the orientation installation).

Two of the elements 103-1, 103-3 thus form a first bowtie and the two other elements 103-2, 103-4 form the other bowtie.

Each of the center radiator cell 102 and ground plane cells 110, 120 are generally defined by conductive surfaces with a dielectric or other non-conductive spacing in between each cell 102, 110, 120. For example, spaces 104 are provided between the various conductive surfaces of center radiator 102 and between center radiator 102 and the innermost ground plane cell 110, and space 105 similarly is provided between the first ground plane cell 110 and the second ground plane cell 120.

Various types of coupling structures 150 can be used, preferred implementations of which are described in greater detail below. What is important is that the couplers 150 provide frequency dependent, passive change in impedance.

The coupling structures 150 disposed between the center cell 102 and ground plane cells 110, 120 either prevent coupling, provide partial coupling, or allow coupling of electromagnetic energy between the cells 102, 110, 120 depending upon the frequency band of operation. Currents generated in each of the respective ground planes from the central radiator coupling are therefore significant and greater than that of a passive ground plane depending on operating frequency. More particularly, only the center cell 102 is active at the highest operating frequency, with the couplings isolating both of the ground plane cells 110, 120. However as the radiating frequency decreases, the inner ground plane cell 110 becomes active, and as the frequency increases further, the outer ground plane cell 120 becomes active. As the operating frequency reaches the lowest designed frequency, both ground plane cells 110, 120 become active and the radiating surface eventually expands to include the entire surface of the antenna structure 100.

The size of the cavity 130 dictates the gain of the overall structure 100. For example, based on the Chu-Harrington relationship, for a minimum frequency of operation of 30 MHz, the cavity 130 should scale to a form factor of approximately 64"×64"×2" in depth. With these dimensions, the antenna structure 100 and is expected to provide a gain of −7 dBi (decibels isotropic).

Figure 2:
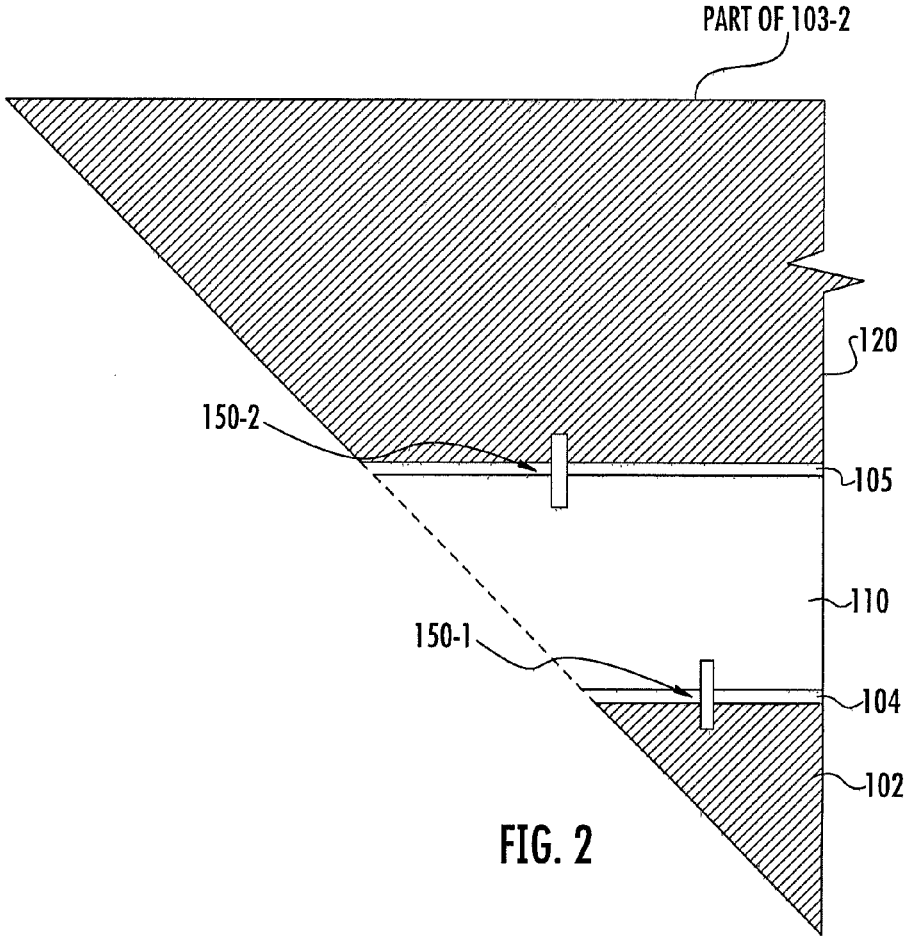
FIG. 2 is a more detailed top view of the antenna of FIG. 1.

FIG. 2 is a top view of one half of one of the triangular elements 103-2. It is presented to show in more detail a portion of center radiator 102, ground planes 110, 120, and respective spaces 104, 105 between the center element 102 and first ground plane 110 and between the first 110 and second ground plane 120. Also shown is the relative orientation of the coupling structures 150-1, 150-2. The specific location of the coupling structures 150-1, 150-2 along the interface between each of the various sections 102, 110, 120 is not as important as determining the particular impedance to achieve the desired coupling.

Figure 3:
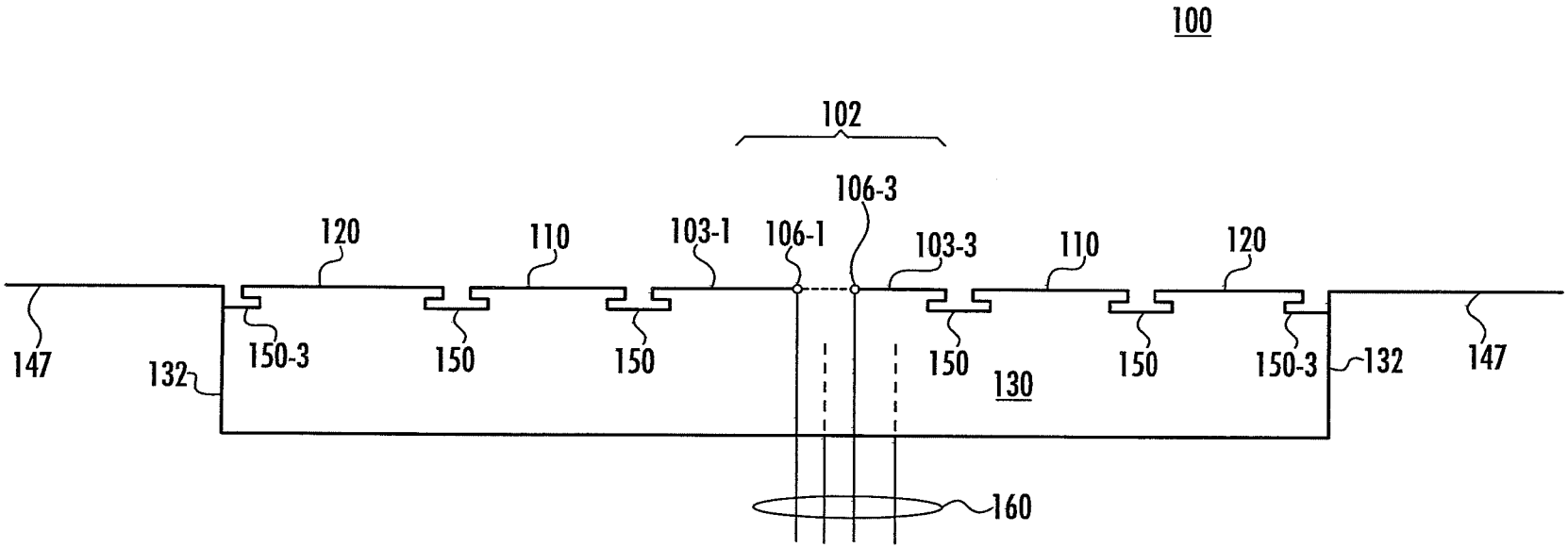
FIG. 3 is a cross-sectional view of the antenna of FIG. 1.

FIG. 3 is a cross-sectional view of the antenna structure 100. Here is more easily seen the cavity 130, the couplings 150 and their relative orientation with respect to the center element 102 and ground plane elements 110, 120. The cavity 130 is seen to be disposed beneath a reference plane 147 provided by the vehicle skin. Lead lines 160 connect the respective feed points 106-1, 106-3 (as well as the other two feed points, 106-2, 106-4 not shown in FIG. 3) to hybrid power combiners and/or transceiver circuitry. It is also seen here in more detail how the coupling structures 150-3 are connected between the upper surface of the element 110 and the sidewall 132 of the cavity 130.

The nature of the antenna structure 100 including the center radiating cell 102 and surface impedance ground plane cells 110, 120 is conformal to a plane with less than two inches of thickness. The nature of the structures is therefore to appear as a solid metallic surface using incorporated into the aircraft electro magnetic design time or other vehicles.

Figure 4:
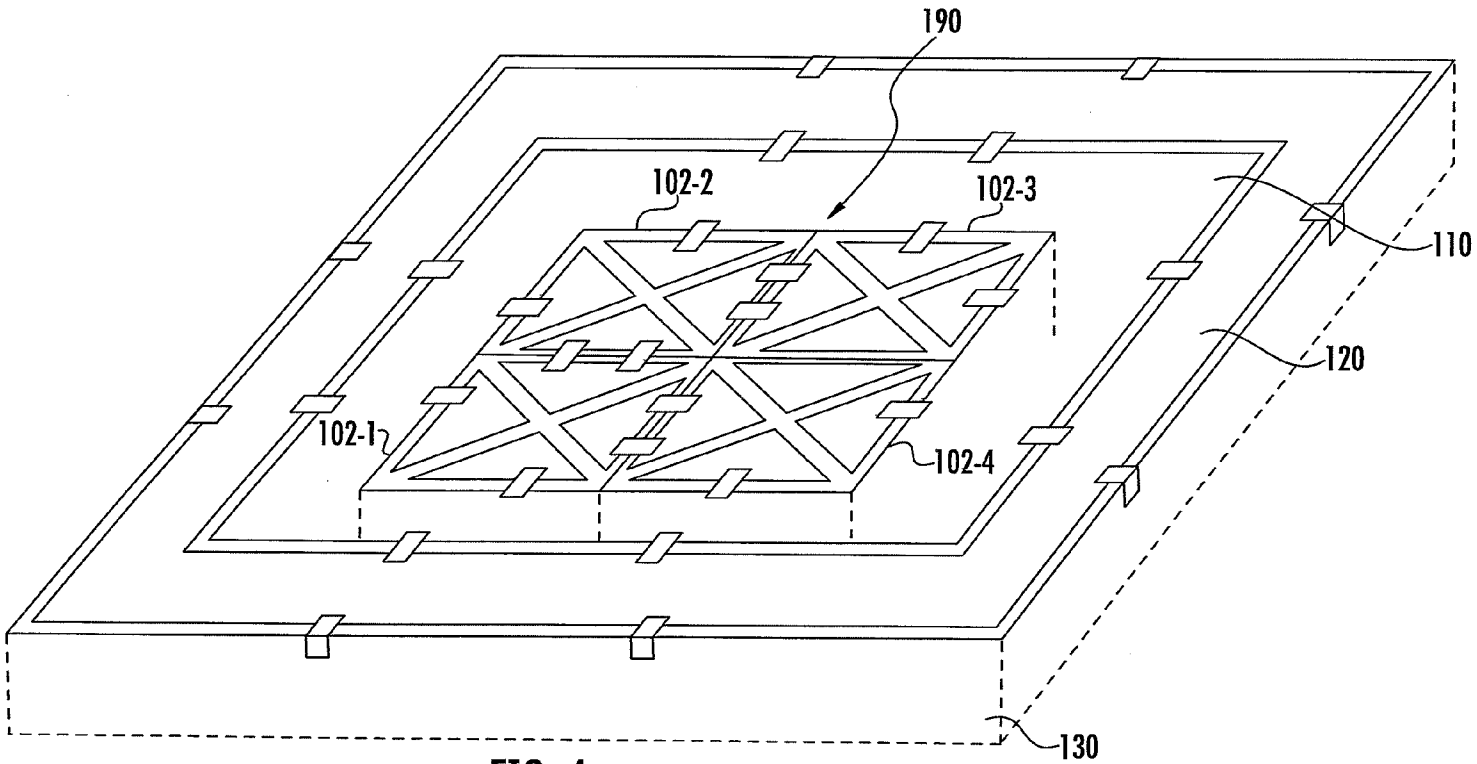
FIG. 4 illustrates an array of unit cells that can provide a monopole-like response.

FIG. 4 illustrates an array 190 that includes four center cells 102-1, 102-2, 102-3, 102-4 with interconnecting couplers 150. An inner ground plane surface 110 and outer ground plane surface 120 surround all four cells 102 of the array 190. Such arrays may include a fewer or greater number of center cells 102 and oriented in various square, rectangular, or other layouts. All cells 102 of the array 190 are placed over a single, common cavity 130. The array 190 provides a conformal phased array that can exhibit various polarizations, depending upon how the individual cells 102 are driven at their feed points 106. In one particular arrangement, the array can approximate the operation of a monopole antenna from a conformal, flat surface.

Figure 5:
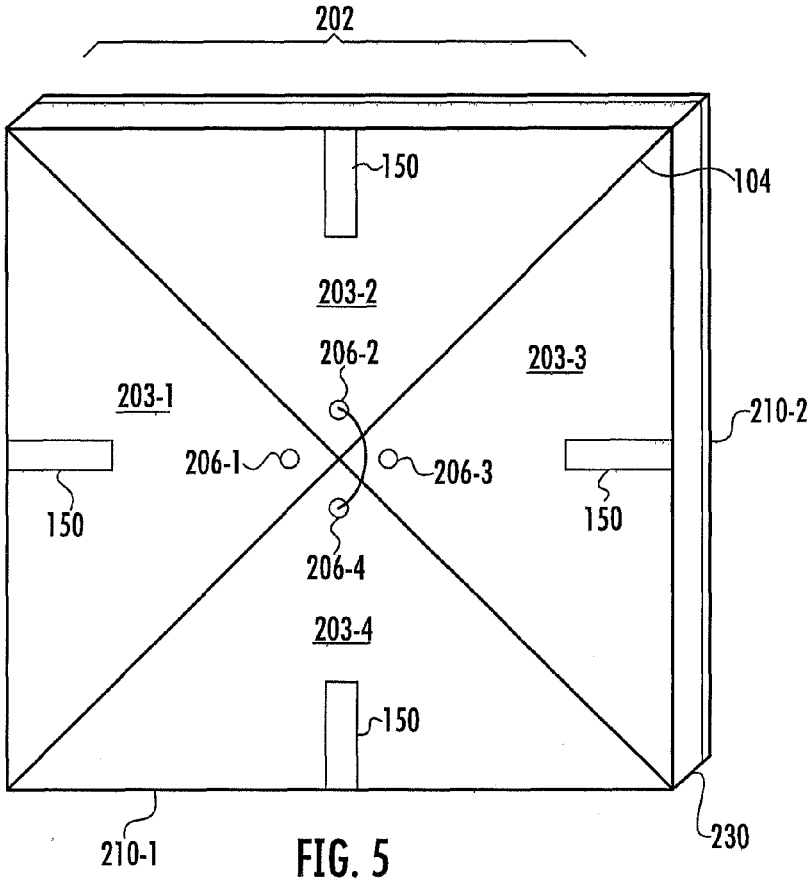
FIG. 5 is an implementation with a unit cell disposed on both sides of a rectangular cavity.

FIG. 5 is another implementation of a radiating cell 202. This implementation still makes use of a cavity structure 230 but has radiating elements on each side of the cavity 230. This form of radiating cell 202 thus consists of a total of eight triangular elements 203-1, 203-2, . . . 203-8 (only four of which are visible in FIG. 5) with four triangular elements 203 located on each of the two faces of the rectangular cavity structure 230. Eight terminal feeds 206-1, 206-2, . . . 206-8, one for each triangular element, allow for interconnection to the other triangular elements to provide the desired polarization. In the illustrated embodiment, for each of the radiating faces, two terminals associated with two selected (i.e., vertical) triangular elements 203-2, 203-4 are shorted together while the two terminals 206 associated with other two remaining horizontal triangular elements 203-1, 203-3 are left open. This provides a desired vertical polarization and resulting omni-directional "monopole" pattern.

The walls of the cavity 230 are connected to their respective adjacent triangular elements by couplers 150, which are preferably fixed-tuned to the desired wideband operation.

A vertical array of radiating unit cells 202 can also be realized. For example, three center cells 302-1, 302-2, 302-3 can be vertically stacked. This is shown in FIGS. 6A and 6B which are cross-sectional and front face views respectively of the same. Here the individual cells are connected to one another through meander lines.

A first cell 302 may provide coverage in a low frequency range of interest (such as from 30-88 MHz, and from 116-174 MHz), a second cell 302-2 may provide coverage in a medium bandwidth of interest (such as from 225-400 MHz), and a third radiating cell 302-3 provide coverage in an upper frequency band of interest (452-512 MHz).

Figure 6C:
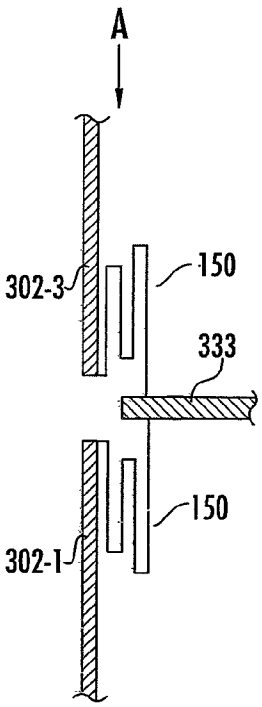
FIGS. 6A, 6B, and 6C are a cross section, front view, and detailed view of a vertically stacked array.
Figure 6B:
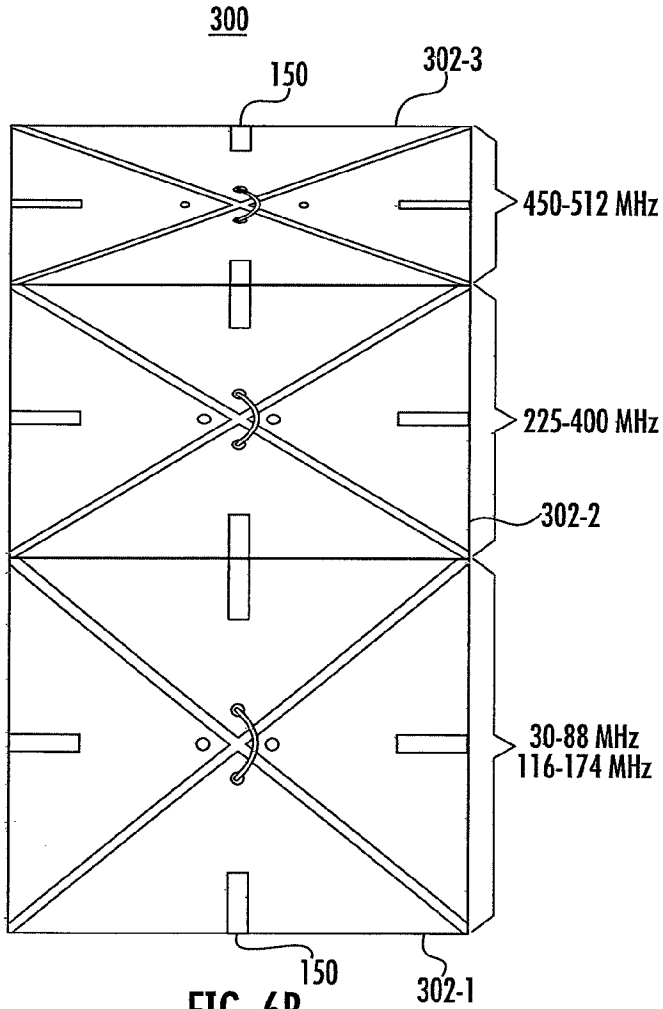
Figure 6A:
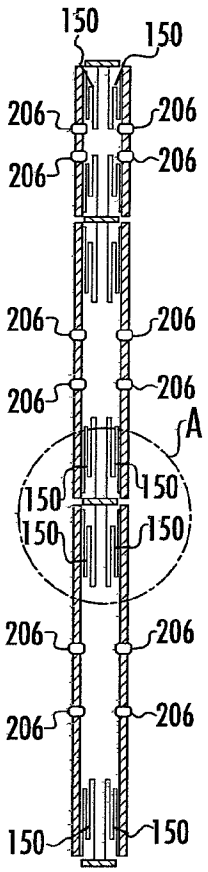

FIG. 6C is a more detailed view of a section A taken from FIG. 6B. This shows the two adjacent cells 302-1, 302-2 and respective meander lines 150 connecting them together. An optional conductive element 333 may be disposed between the meander lines 150. The conductive element 333 may itself be electroactively controlled to give further precision to the coupling between cells 302-1, 302-2.

This single structure MultiBand Antenna solution (MBA) therefore consolidates three radiating unit cells 302 (sized respectively at 3 inches, 5 inches and 7 inches in height). Couplers 150 interconnect the stacked radiating units cells 302 to one another. This arrangement achieves low VSWR and broadband coverage. A single feed point can be connected to the bottom radiating unit cell 302-1 and diplexers provided (not shown) to further ensure isolation between the four frequency bands of interest.

Figure 7:
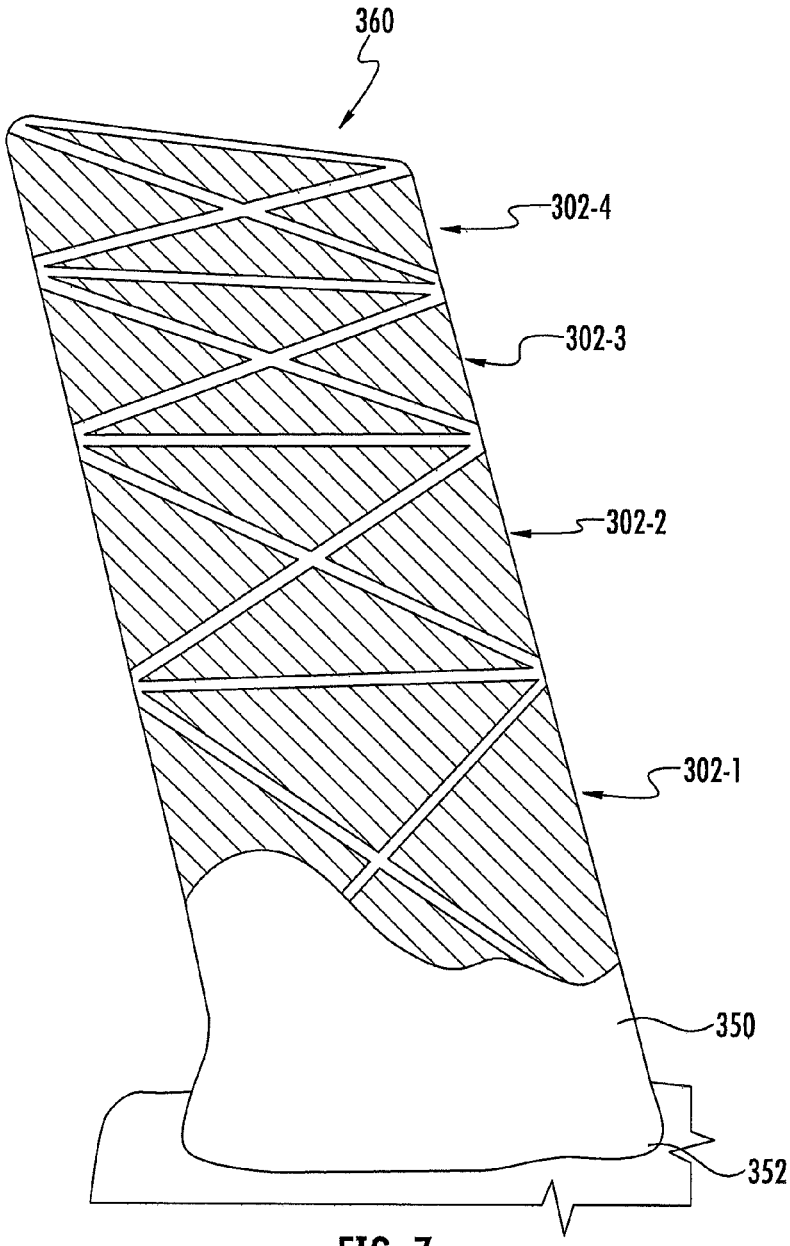
FIG. 7 is a vertically stacked array arranged as a blade type antenna.

An additional bowtie element 302-4, as shown in FIG. 7, with a separate feed can be positioned directly above the three vertically stacked elements 302-1, 302-2, 302-3. The resulting array can be packaged in a blade-type enclosure suitable for attachment to high speed vehicles such as aircraft. The fourth element 302-4 can be 2.5 inch in height to cover the 2200-2500 MHz band.

The arrangement shown in FIG. 7 has an overall height of 17½ inches and is a solution that provides vertical polarization with an unidirectional pattern enabling −12.0 dBi of gain at 30 MHz, with monotonically increasing gain up to 512 MHz. A multichannel output can be provided by a diplexer embedded in the base 352 of the unit.

Figure 8:
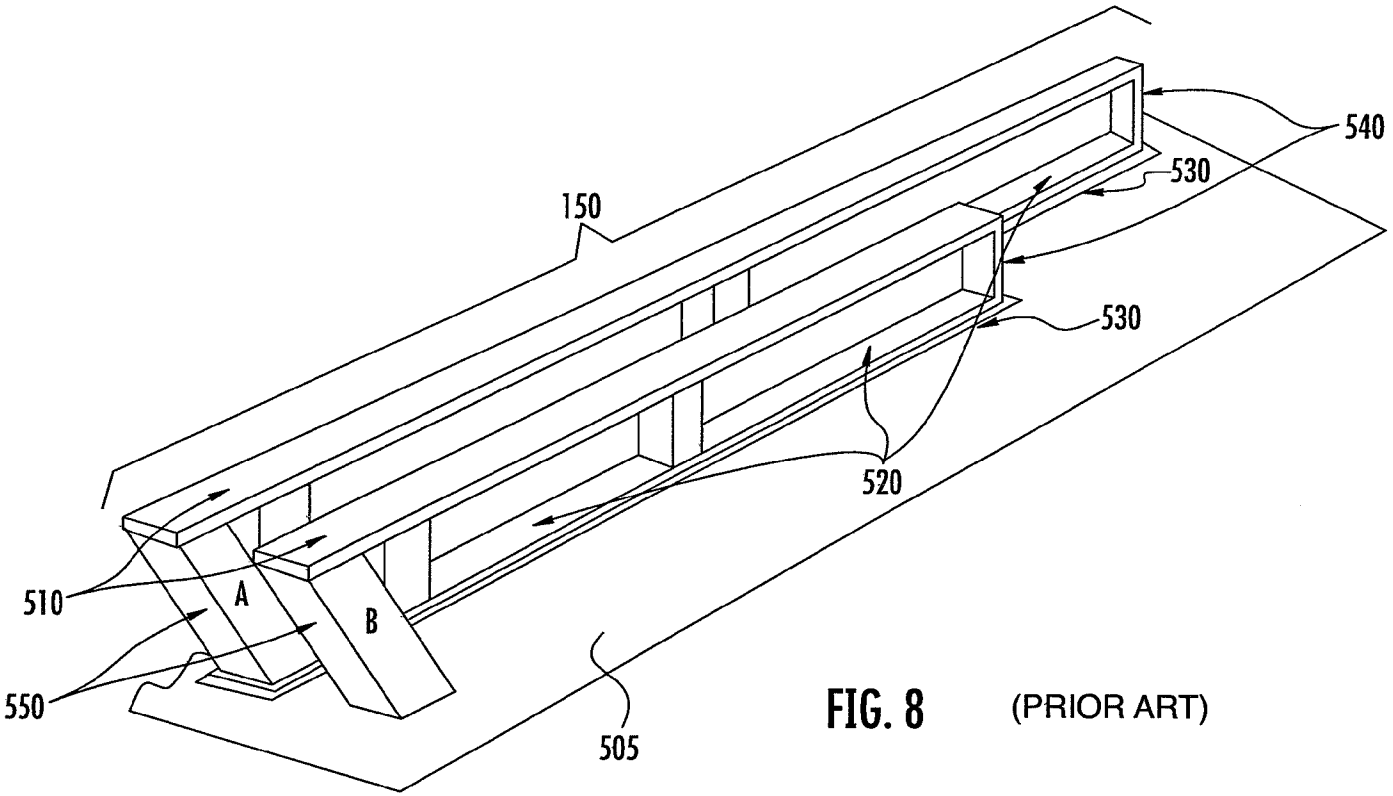
FIG. 8 (PRIOR ART)
FIG. 8 is one possible implementation of a variable coupling structure.

FIG. 8 shows one implementation of the frequency dependent coupling 150 as a meander line structure that provides passive control over impedance. This particular implementation is along the lines of that shown in U.S. Pat. No. 6,313,716. Elements of the meander line structure 150 are placed over an electrically conductive plate 505. Alternating low impedance sections 520 run horizontally in a lower section of the structure, e.g., positioned most closely to the conductive plate 505. High impedance horizontally running sections 510 are placed in an upper section of the structure, e.g., positioned further away from the conductive plate 505. The low impedance sections 520 are electrically insulated from the conductive plate 505 such as by a Teflon insulator pad 530 located in close proximity to the plate 505, to produce a relatively low characteristic impedance. Conversely, the high impedance sections 510 are characterized by a larger separation from the plate 505 to provide high characteristic impedance.

The low impedance sections 520 are connected by diagonal 550 or end 540 interconnects. The end interconnects 540 can be vertically (e.g., orthogonally) disposed metallic portions which connect the low impedance 520 and high impedance 510 sections to each other. Diagonal interconnects 550 can be used to connect a low impedance and high impedance section or to connect the high impedance section to a terminal (B). The serially interconnected alternating impedance sections provide mismatched switching along the underlying structure, which gives the meander line the desired "low-wave" propagation characteristics.

In this particular implementation of a conformed antenna in FIGS. 1-6, ground plane cells 110, 120 provide the conductive plate 505 and the terminal (B) is a cavity connection. As a result, the meander line 150 (in conjunction with the cavity walls) provides the desired low VSWR.

Figure 9:
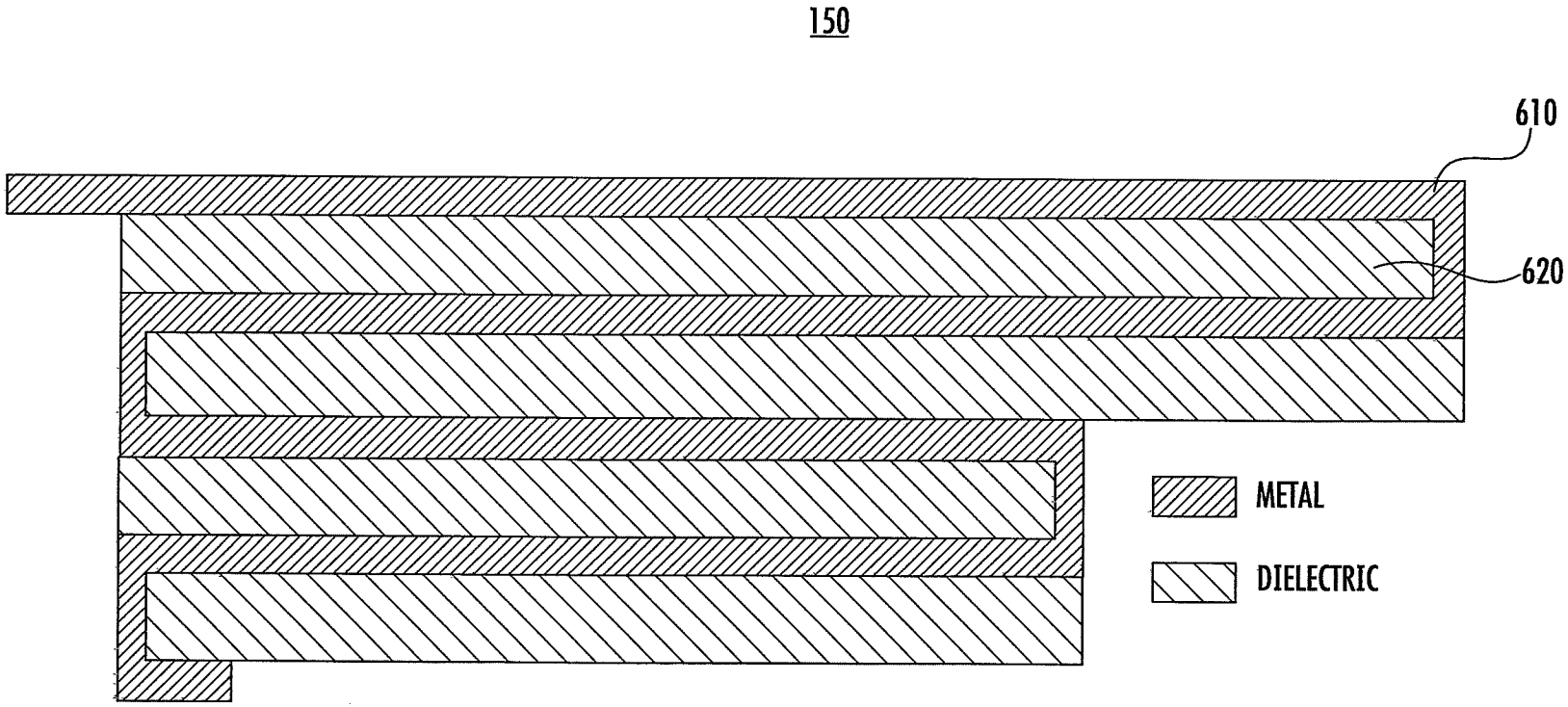
FIG. 9 is another implementation of the variable coupling structure.

In another implementation, a Variable Impedance Transmission Line (VITL) can provide the desired passively tunable coupling 150. FIG. 9 is one such implementation that provides this behavior. This approach enables inductive tuning of the conformal antenna structure 100 (FIG. 1) with a reduced aperture size as compared to what would otherwise be necessary to achieve a given efficiency.

More particularly, the VITL implementation 150, shown in FIG. 9, is composed of serially interconnected, alternating low impedance and high impedance transmission line sections. As shown, this can be formed by a meander line embedded as a "back-and-forth" metallic strip 610 in or on an interposed dielectric substrate 620. The high impedance sections decrease in size along the metallic strip. This arrangement thus provides mismatched switch impedance along the structure, and results in the desired "slow wave" propagation characteristic.

Figure 10:
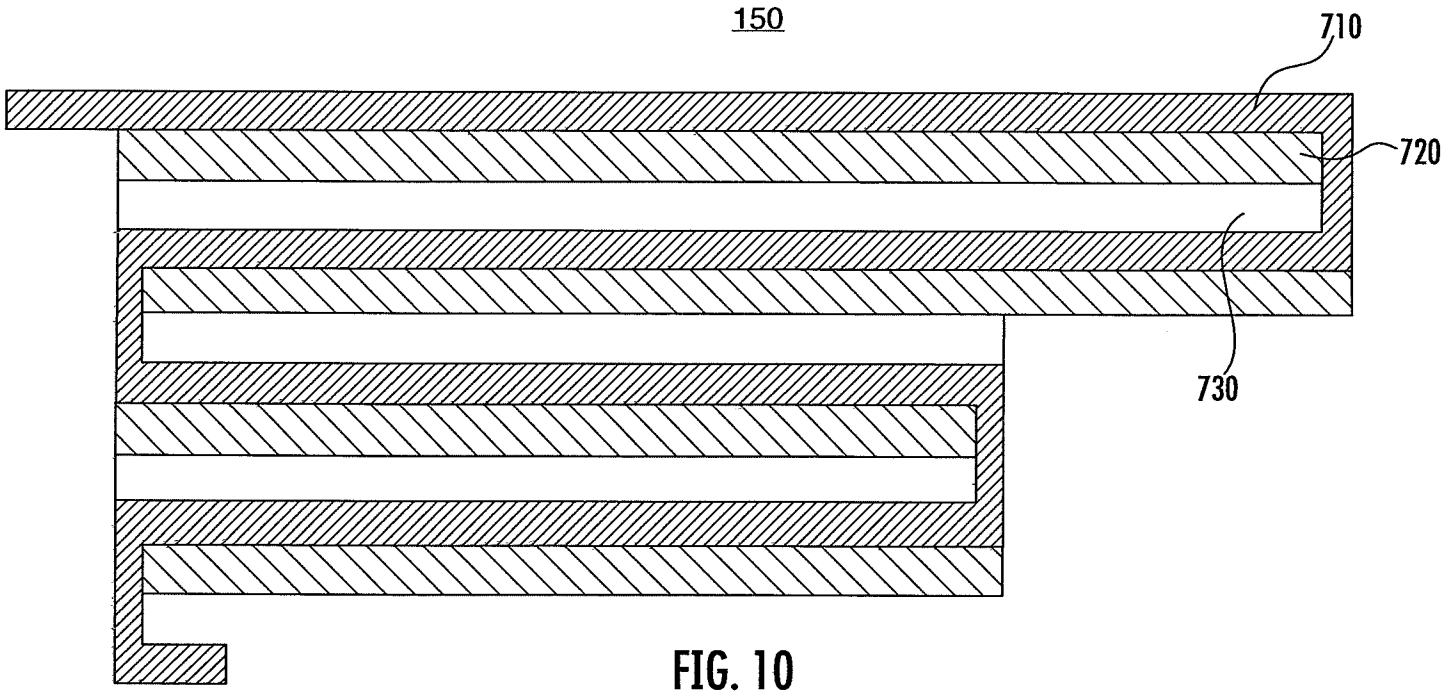
FIG. 10 is a still further implementation of a variable coupling structure.

FIG. 10 shows another embodiment of a VITL making use of electroactively tuned actuator sections. As with FIG. 9, the implementation shown in FIG. 10 is a side view with the layer thicknesses exaggerated. In this implementation, called a Tunable Variable Impedance Transmission Line (TVITL), electroactive actuators 720 are disposed between the metal transmission line sections 710 and the dielectric 730. Upon application of an electric field to the actuators 720, they will change in thickness, and thereby alter the effective spacing between the dielectric layers 730 and metal 710 layers. Metaferrite properties are therefore observed without using any actual ferrite material.

Control voltages can be applied to the electroactive actuators according to the techniques described in co-pending U.S. patent application Ser. No. 13/431,217 filed Mar. 27, 2012 entitled "Tunable Transversal Structures", the entire contents of which are hereby incorporated by reference.

While this invention has been particularly shown and described with references to example embodiments thereof, it will be understood by those skilled in the art that various changes in form and details may be made therein without departing from the scope of the invention encompassed by the appended claims.

What is claimed is:

1. An apparatus comprising:

a cavity having conductive walls disposed below a reference plane;

a center radiating surface located on or above the reference plane and located above the cavity;

one or more surrounding ground plane surfaces, disposed on and co-planar with the reference plane above the cavity, and outboard of the center radiating surface, the ground plane surfaces electrically surrounding the center radiating surface; and frequency dependent couplings, disposed between the center radiating surface and at least one of the surrounding ground plane surfaces, and also disposed between at least one of the surrounding ground plane surfaces and at least one conductive wall of the cavity;

and further wherein the center radiating surface comprises a quadrilateral surface having four sides;

the quadrilateral surface area comprises four conductive triangular shaped surfaces, disposed such that bases of the triangular surfaces are aligned with respective sides of the quadrilateral surface; and the surrounding ground plane surfaces further comprise:

a set of four ground plane surfaces, each disposed adjacent to and outboard of a respective one of the four sides of the quadrilateral surface; and at least four frequency dependent couplings, each frequency dependent coupling disposed between a respective one of the ground plane surfaces and quadrilateral surfaces.

2. The apparatus of claim 1 wherein the center radiating surface further comprises:

an array of two or more center radiating surfaces, with the array disposed inboard of the surrounding ground plane surfaces.

3. The apparatus of claim 1 where the conductive triangular surfaces each have a respective feed point, with the feed points from two opposing triangular surface shorted together, and the other two remaining feed points being left open.

4. The apparatus of claim 1 further comprising:

a second center radiating surface disposed on or above a second reference plane on an opposite side of the cavity from the first reference plane;

one or more second surrounding ground plane surfaces, disposed on and coplanar with the second reference plane and outboard of the second center radiating surface, the second ground plane surfaces electrically surrounding the second center radiating surface;

a second set of frequency dependent couplings, disposed between the second center radiating surface and at least one of the surrounding second ground plane surfaces, and also disposed between at least one of the surrounding second ground plane surfaces and at least one conductive wall of the cavity.

5. The apparatus of claim 4 providing an approximate monopole response pattern.

6. The apparatus of claim 1 wherein the frequency dependent couplings are meander lines.

7. The apparatus of claim 1 wherein the frequency dependent couplings are Variable Impedance Transmission Lines (VITLs).

8. The apparatus of claim 7 wherein the frequency dependent couplings are further implemented with two or more transmission line sections disposed in parallel with one another, and a dielectric section disposed between at least two of the transmission line sections.

9. The apparatus of claim 8 wherein the frequency dependent couplings further comprise:

an electroactive layer, disposed between the transmission line sections and the dielectric section.

10. The apparatus of claim 1 wherein the surrounding ground plane surfaces further comprise:

a set of outer plane surfaces, each disposed coplanar with and adjacent to and outboard of a respective one of the set of four ground plane surfaces; and additional frequency dependent couplings disposed between each of the set of outer surfaces and each of the set of ground plane surfaces.

* * * * *

UNITED STATES PATENT AND TRADEMARK OFFICE

CERTIFICATE OF CORRECTION

PATENT NO. : 9,147,936 B1
APPLICATION NO. : 13/536445
DATED : September 29, 2015
INVENTOR(S) : John T. Apostolos It is certified that error appears in the above-identified patent and that said Letters Patent is hereby corrected as shown below:

In the Claims:

Claim 3, Col. 8, line 1 should read:
3. The apparatus of claim 1 wherein the conductive triangular Claim 3, Col. 8, line 3 should read:
points from two opposing triangular surfaces shorted together, Claim 3, Col. 8, line 4 should read:
and the feed points being left open.

Signed and Sealed this
Eighth Day of March, 2016

Michelle K. Lee

Michelle K. Lee
*Director of the United States Patent and Trademark Office*